US009821938B2

(12) United States Patent
Valentine

(10) Patent No.: US 9,821,938 B2
(45) Date of Patent: Nov. 21, 2017

(54) UNIVERSAL CLOSURE APPARATUS WITH DELIVERY SYSTEM

(76) Inventor: Craig R. Valentine, Scottsdale, AZ (US)

( * ) Notice: Subject to any disclaimer, the term of this patent is extended or adjusted under 35 U.S.C. 154(b) by 176 days.

(21) Appl. No.: 13/566,429

(22) Filed: Aug. 3, 2012

(65) Prior Publication Data

US 2014/0034523 A1 Feb. 6, 2014
US 2017/0259963 A9 Sep. 14, 2017

Related U.S. Application Data

(63) Continuation of application No. 12/553,743, filed on Sep. 3, 2009, now Pat. No. 8,302,770, which is a continuation-in-part of application No. 11/717,517, filed on Mar. 13, 2007, now abandoned.

(60) Provisional application No. 60/870,978, filed on Dec. 20, 2006, provisional application No. 61/093,970, filed on Sep. 3, 2008, provisional application No. 61/097,498, filed on Sep. 16, 2008, provisional application No. 61/239,635, filed on Sep. 3, 2009.

(51) Int. Cl.
*B65D 81/32* (2006.01)
*B65D 51/28* (2006.01)

(52) U.S. Cl.
CPC ..... *B65D 51/2821* (2013.01); *B65D 81/3205* (2013.01); *B65D 81/3211* (2013.01); *B65D 81/3255* (2013.01)

(58) Field of Classification Search
CPC B65D 81/32; B65D 81/3211; B65D 81/3205; B65D 81/3255; B65D 51/28; B65D 51/2814; B65D 51/2821; B01F 13/005; A61J 1/2096
USPC ..... 206/219, 222, 221; 215/DIG. 8, 6; 220/521, 522
See application file for complete search history.

(56) References Cited

U.S. PATENT DOCUMENTS

| | | | | |
|---|---|---|---|---|
| 5,283,038 | A | 2/1994 | Seymour | |
| 5,366,114 | A * | 11/1994 | Bernstein et al. | 222/83 |
| 5,370,222 | A * | 12/1994 | Steigerwald et al. | 206/222 |
| 6,138,821 | A * | 10/2000 | Hsu | 206/222 |
| 6,527,110 | B2 * | 3/2003 | Moscovitz | B65D 51/2835 206/222 |
| 6,533,113 | B2 * | 3/2003 | Moscovitz | 206/222 |
| 6,679,375 | B1 * | 1/2004 | Coory | 206/219 |

(Continued)

*Primary Examiner* — Steven A. Reynolds
(74) *Attorney, Agent, or Firm* — Polsinelli PC; Adam C. Rehm

(57) ABSTRACT

A universal bottle cap capable of threadably engaging two or more bottles of a different thread arrangement having a substance retained therein. The universal bottle cap threadedly engages a bottle containing a beverage therein. Such universal bottle cap includes a cylindrical member closed at a first end thereof and open at a second end thereof. There is a threaded portion disposed on an inner surface of the cylindrical member for engaging a threaded end of such bottle. A capsule like device is disposed inside the cylindrical member adjacent the closed end for retaining a substance to be dispensed into a beverage in such bottle. A device for piercing the capsule engages each of the threaded portion of the bottle cap and the capsule for piercing the capsule as the universal bottle cap is threaded onto such bottle thereby releasing contents of the capsule into such beverage for mixing therewith.

22 Claims, 3 Drawing Sheets

(56) References Cited

U.S. PATENT DOCUMENTS

| | | | | |
|---|---|---|---|---|
| 6,908,011 | B2 * | 6/2005 | Cho | B65D 51/2864 222/129 |
| 6,935,493 | B2 * | 8/2005 | Cho | B65D 51/2835 206/222 |
| 6,974,024 | B2 * | 12/2005 | Cho | B65D 51/2864 206/219 |
| 6,994,211 | B2 * | 2/2006 | Cho | B65D 51/2864 206/219 |
| 7,249,690 | B2 * | 7/2007 | Smith | B65D 51/2835 206/219 |
| 7,475,774 | B2 * | 1/2009 | Clarkson | B65D 51/2835 206/222 |
| 7,607,460 | B2 * | 10/2009 | Johns | B65D 81/3211 141/319 |
| 7,854,343 | B2 | 12/2010 | Ellson et al. | |
| 7,882,976 | B1 * | 2/2011 | Goede | 220/258.1 |
| 7,896,155 | B2 * | 3/2011 | Seelhofer | B65D 51/2835 206/219 |
| 8,221,381 | B2 | 7/2012 | Muir et al. | |
| 8,226,126 | B2 * | 7/2012 | Johns | A61J 1/2089 206/222 |
| 2002/0179461 | A1 * | 12/2002 | Mollstam | B65D 47/2031 206/222 |
| 2005/0218015 | A1 * | 10/2005 | Spector | B65D 51/2828 206/222 |
| 2008/0116086 | A1 * | 5/2008 | Hung | 206/222 |
| 2009/0261000 | A1 * | 10/2009 | Epp et al. | 206/222 |
| 2012/0285985 | A1 * | 11/2012 | Jones | 222/1 |

* cited by examiner

UNIVERSAL CLOSURE APPARATUS WITH DELIVERY SYSTEM

CROSS REFERENCE TO RELATED APPLICATION

This application claims priority to and is a continuation of U.S. patent application Ser. No. 12/553,743 filed Sep. 3, 2009, and has now issued as U.S. Pat. No. 8,302,770. Application Ser. No. 12/553,743 is a continuation-in-part of now-abandoned U.S. patent application Ser. No. 11/717,517 filed Mar. 13, 2007, which claims the benefit of U.S. Patent Application No. 60/870,978 filed Dec. 20, 2006. U.S. patent application Ser. No. 12/553,743 also claims the benefit of U.S. Patent Application No. 61/093,970 filed Sep. 3, 2008, U.S. Patent Application No. 61/097,498 filed Sep. 16, 2008, and U.S. Patent Application No. 61/239,635 filed Sep. 3, 2009. The disclosures of all of these applications are incorporated herein by reference in their entireties to the extent permitted by law.

BACKGROUND OF THE INVENTION

1. Field of the Invention

The present general inventive concept relates, in general, to screw type bottle caps used to close any container apparatus and, more particularly, the present general inventive concept relates to a screw type bottle cap having a predetermined substance retained therein which substance is to be dispensed into the contents of the bottle and the cap adapted to fit on bottles having a plurality of different sizes and/or shapes.

2. Description of the Related Art

Prior to the conception and development of the present general inventive concept, as is generally well known in the prior art, screw type caps are in wide spread use throughout the beverage packaging industry. Such screw type bottle caps are used, for example, on water, pop, sport drinks and juice bottles.

The beverage packaging industry utilizes a plurality of different sized and shaped bottles having different sized and shaped bottle-closure devices or bottle caps that to threadably engage each different sized and shaped bottle. Further, the threaded engagements vary.

None of the present day bottle caps which are presently being used have the ability to easily dispense a predetermined substance into the contents of the bottle for any desired purpose. Applicant is aware of some screw type bottle caps which do possess this capability, however, due to their complexity they are not, to the best of applicant's knowledge being used. See, for example, U.S. Pat. Nos. 6,820,740; 6,962,254; 6,569,329; 6,221,416; 7,005,152; 6,165,523 and 5,932,262.

SUMMARY OF THE INVENTION

The present general inventive concept provides, in a first aspect, a bottle cap having a predetermined substance retained therein. The bottle cap is engageable with a bottle containing a preselected beverage therein and having a threaded end for receiving a bottle cap.

Such bottle cap includes a cylindrical member that is closed at a first end thereof and open at a second end thereof. The cylindrical member has each of a first predetermined length and a predetermined inside diameter. There is a threaded portion disposed on an inner surface of the cylindrical member, beginning adjacent such open end and extending inwardly a second predetermined length toward the closed end, for engaging such threaded end of the bottle.

A first means, an internal bladder, is disposed inside the cylindrical member adjacent such closed end thereof for retaining a preselected substance therein to be dispensed into such preselected beverage contained within the bottle. Additionally, a second means, a bladder piercing element, is provided which is engageable with each of such threaded portion of the bottle cap and such first means for retaining the preselected substance for piercing the first means as such bottle cap is threaded onto such threaded portion of such bottle thereby releasing the contents of such first means into such beverage for mixing therewith. The internal bladder stores ingredients such as vitamins, syrup, gas, and/or the like such that the bottle cap delivers the ingredients into the bottle when the bladder is opened by a user.

According to a second aspect, the present general inventive concept provides a bottle cap similar to the embodiment described above except the second means is engageable with each of an upper surface of such bottle and such first means for retaining the preselected substance for piercing such first means as the bottle cap is threaded onto such threaded portion of such bottle thereby releasing contents of the first means into such beverage for mixing therewith. This embodiment of the present general inventive concept further requires a retaining ring which engages with a bottom surface of such second means and an upper surface of such bottle for retaining the second means in position in such bottle cap.

The present general inventive concept is a universal cap designed with a multi-thread closure system to threadably engage a plurality of bottles having different thread designs, shapes, and/or sizes. This allows the present general inventive concept to be used with a wide variety of bottles that employ industry standard threads. That is, a multi-thread closure that can be used with existing bottle apparatus that is made as a single, double, and/or triple lead thread design.

The present general inventive concept is designed to overlay a plurality of the current thread standards without any sections having threads that may interfere with each other. In this manner, the present general inventive concept provides a staggered thread design that will adapt by elastically flexing to catch and hold onto a single, double, or triple thread apparatus design in a manner that is sufficient to seal and close the bottle.

It is, therefore, one of the primary objects of the present general inventive concept to provide a screw type bottle cap capable of dispensing a predetermined substance into a predetermined liquid contained in a bottle.

The present general inventive concept also provides a package of screw type bottle caps having a predetermined substance contained therein for screwing onto a bottle coating a predetermined beverage therein and thereafter dispensing such predetermined substance in to such predetermined beverage.

The present general inventive concept also provides a screw type bottle cap having one of preselected flavorings, preselected vitamins and preselected medications contained therein for dispensing into a beverage contained within a bottle.

The present general inventive concept also provides a screw type bottle cap capable of dispensing a predetermined substance into a predetermined liquid contained in a bottle which is relatively inexpensive to manufacture.

The present general inventive concept also provides a screw type bottle cap capable of dispensing a predetermined substance into a predetermined liquid contained in a bottle simple to use.

The present general inventive concept also provides a 3-snap/position lid wherein each snap indicates a step, e.g., 1. secured without bladder penetrated; 2. bladder penetrated; 3. secured with bladder penetrated. The snap may be audible and/or provide physical resistance such that a user is aware of each step 1, 2, and/or 3 during the mechanical twisting that occurs during this function. The threads catch and flex to properly align at the end of the thread tracking to create an adequate seal of the bottle.

The present general inventive concept also provides threading of the cap is universal, e.g., fits on different threaded, sized, and/or shaped bottles. 1. The default configuration is the Standard single thread with a 0.125" pitch; 2. Triple lead thread with a pitch of 0.240"×one revolution, but it is patterned every 120 degrees around the cap; 3. The "Multi" thread consists of short bits of thread that occur where the other two coincide with one another.

The present general inventive concept may include a manual release lever or button so that the cap contents can be dumped without threadingly engaging a bottle, for instance, into a standard glass, cup, and/or other container that either is not equipped with a threaded receiver to receive the present general inventive concept or is not equipped with a threaded received that will accommodate the present general inventive concept. The lever or button manually moves a bladder opener upward to pierce the bladder and dump the ingredients into a container. The lever may include two tabs that extend from the bladder opener through openings or tracks on either side of the cap such that a user may hold the tabs to secure the bladder opener in place with one hand while the cap is rotated with the other hand. Such movement acts to move the bladder opener toward the bladder end of the cap to pierce the bladder.

Alternatively, the manual release may be surface area on a bottom surface of the bladder opener such that a user may manually push the bladder opener into the bladder seal to open the seal. After the seal is opened, the user may dump the ingredients into a container using gravity and/or shaking the present general inventive concept.

The present general inventive concept may include a seal to contain and/or seal the ingredients in the bladder, e.g. a seal made of a thin metal such as aluminum or a plastic material. In the preferred embodiment, the present general inventive concept is a very brittle aluminum foil that lends itself to breakage. The current method of sealing the seal onto the cap to close the bladder is induction.

The present general inventive concept also provides an axially moving bladder opener that pierces the bladder to dump the contents into a container such as a bottle. The bladder is designed to be pierced in a center thereof such that all of the ingredients are easily emptied into the container leaving no ingredients within the bladder. Such prevents undesired spilling of the ingredients after removal of the cap, e.g., in a pocket of a user if the user is not able to immediately dispose of the cap.

The present general inventive concept also provides a bladder opener with a low profile that is situated under the bladder within the bottle closure device such that a size of the bladder may be maximized to store a larger amount of ingredients therein. Specifically, the bladder design maximizes the amount of space provided within the bottle closure such that over 50% of the space provided within the bottle closure is ingredient storage area.

The present general inventive concept also provides an opening in an upper side of the cap, such as a spout, such that upon engagement to a bottle and release of contents within the cap, the spout may be selectively opened by pulling the spout away from the bottle and/or selectively closed by pushing the spout toward the bottle, such that when the spout is open, the contents may exit the bottle, e.g., for consumption by a user and the like, without removing the cap yet and when the spout is closed, the contents are securely stored within the bottle, e.g., for mixing, storage, and the like.

The present general inventive concept also provides a vertical track to permit the capsule-penetrating element to be moved upward and toward the capsule and at least one tab extending laterally from the reservoir opening element and into the vertical track to permit the reservoir opening element to be moved vertically toward the reservoir without rotating.

The foregoing objects and/or other aspects and utilities of the present general inventive concept may be achieved by providing a universal bottle cap having a predetermined substance retained therein, said universal bottle cap capable of threadably engaging two or more bottles having a different thread arrangement, the two or more bottles containing a preselected beverage therein and having a threaded end to receive the universal bottle cap, said universal bottle cap including a cylindrical member closed at a first end thereof and open at a second end thereof, said cylindrical member having each of a first predetermined length and a predetermined inside diameter, a threaded portion disposed on an inner surface of said cylindrical member, beginning adjacent said open end and extending inwardly a second predetermined length toward said closed end, to engage such threaded end of such bottle, a first means disposed inside said cylindrical member adjacent said closed end thereof to retain said predetermined substance therein to be dispensed into such preselected beverage contained within said bottle, and a second means engageable with each of said threaded portion of said bottle cap and said first means for retaining said preselected substance to pierce said first means as said bottle cap is threaded onto such threaded portion of such bottle thereby releasing contents of said first means into such beverage for mixing therewith.

The predetermined substance may be one of a flavor, a vitamin, and a medication.

The liquid vitamins may be one of a multi-vitamin and a baby vitamin.

The medication may be one of an aspirin, and an antibiotic.

The preselected beverage may be one of a water, a juice and a soda.

The second predetermined length of said threaded portion may be at least of a length sufficient to permit said second means to move upwards to pierce said first means.

The first means may be a capsule.

The second means may include a pyramid shaped upper portion having two, three, or four arms that project from a center point.

The present general inventive concept may include an opening in the first end thereof that is selectively opened or closed to provide access to said contents.

The foregoing objects and/or other aspects and utilities of the present general inventive concept may also be achieved by providing universal bottle cap capable of threadably engaging two or more bottles of a different thread arrangement, the universal bottle cap having a predetermined substance retained therein and a threaded end, said universal bottle cap including a cylindrical member closed at a first end thereof and open at a second end thereof, said cylindrical member having each of a first predetermined length and a predetermined inside diameter, a threaded portion disposed on an inner surface of said cylindrical member, beginning adjacent said open end and extending inwardly a second predetermined length toward said closed end, a first means disposed inside said cylindrical member adjacent said closed end thereof for retaining a preselected substance therein, and a second means engageable with said first means for retaining said preselected substance for piercing said first means thereby releasing contents of said first means.

The predetermined substance may be one of a flavor, a vitamin and a medication.

The vitamins may be one of a multi-vitamin and a baby vitamin.

The medication may be one of an aspirin, a cough medicine and an antibiotic.

The second predetermined length of said threaded portion may be at least of a length sufficient to permit said second means to move upwards to pierce said first means.

The first means may be a capsule.

The second means may include a pyramid shaped upper portion.

The foregoing objects and/or other aspects and utilities of the present general inventive concept may also be achieved by providing a universal cap element capable of threadably engaging two or more bottles of a different thread arrangement, the universal cap element including an upper wall and a lower wall, a peripheral skirt depending from the upper wall, a reservoir situated between the upper wall and lower wall, a reservoir opening element situated below the lower wall.

The present general inventive concept may also include engagement means to permit the reservoir opening element to move upward and toward the lower wall.

The present general inventive concept may also include one of a helical track or a vertical track to permit the reservoir opening element to be moved upward and toward the lower wall.

The present general inventive concept may also include a substance housed within the reservoir that is releasable by the reservoir opening element.

The reservoir opening element may have at least one aperture therethrough.

The present general inventive concept may also include an opening in the upper wall that is selectively opened or closed to provide access to said reservoir.

In addition to the various objects and advantages of the present general inventive concept described with some degree of specificity above it should be obvious that additional objects and advantages of the present general inventive concept will become more readily apparent to those persons who are skilled in the relevant art from the following more detailed description of the general inventive concept, particularly, when such description is taken in conjunction with the attached drawing figures and with the appended claims.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE INVENTION

Figure 1:
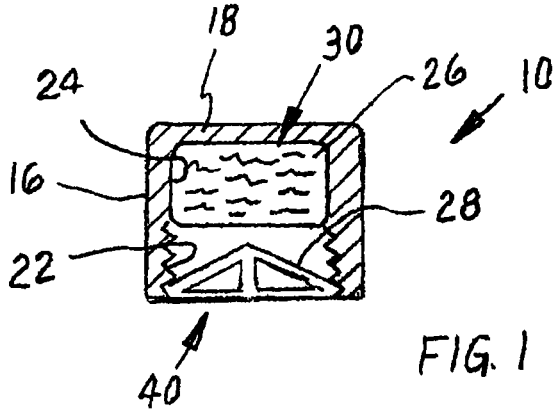
FIG. 1 is a side elevation view, partially in cross section, which illustrates a bottle cap formed according to a presently preferred embodiment of the present general inventive concept prior to being screwed onto the bottle.

Prior to proceeding to the more detailed description of the present general inventive concept it should be noted that, for the sake of clarity and understanding, identical components which have identical functions have been identified with identical reference numerals throughout the several views illustrated in the drawing figures.

Figure 2:
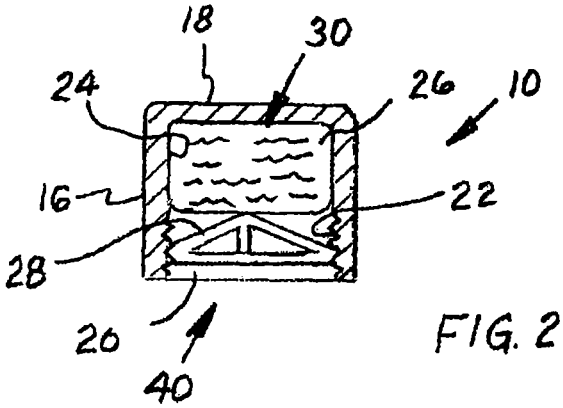
FIG. 2 is a side elevation view, partially in cross section, of the bottle cap, illustrated in FIG. 1, which is ready to be attached to the bottle top, but prior to piercing the capsule containing the substance to be dispensed.
Figure 3:
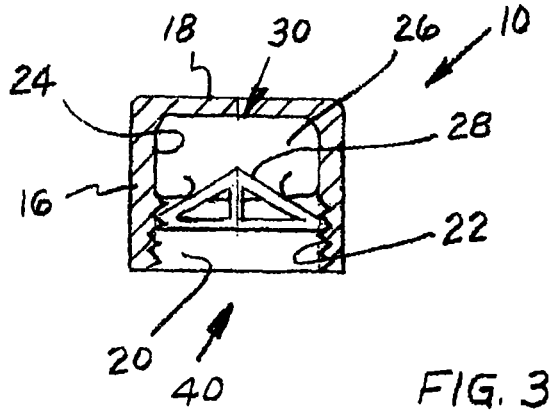
FIG. 3 is a side elevation view, partially in cross section, of the bottle cap, illustrated in FIGS. 1 and 2, which has been attached to the bottle top and piercing of the capsule containing the substance to be dispensed has occurred.
Figure 4:
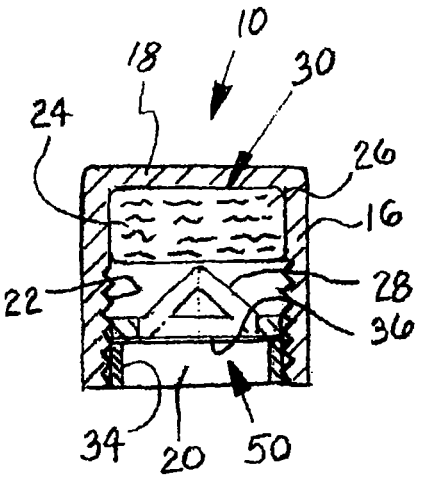
FIG. 4 is a side elevation view, partially in cross section, of an alternative embodiment for the bottle cap which is ready to be attached to the bottle top, but prior to piercing the capsule containing the substance to be dispensed.
Figure 5:
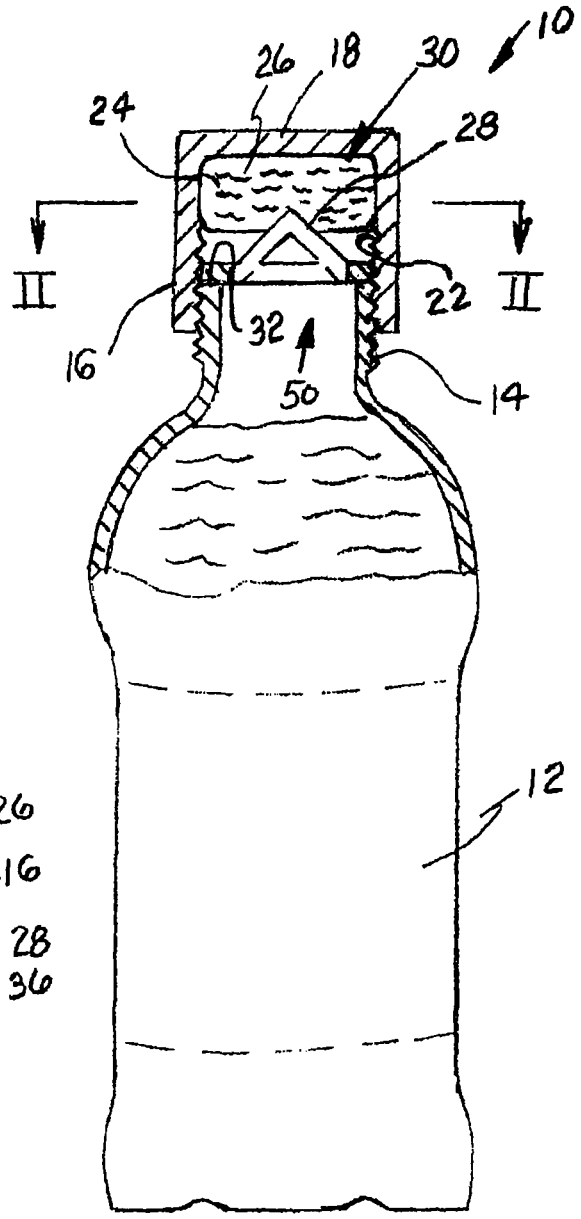
FIG. 5 is a side elevation view, partially in cross section, of the bottle cap, illustrated in FIG. 4, which has been attached to the bottle top and piercing of the capsule containing the substance to be dispensed has occurred.
Figure 6:
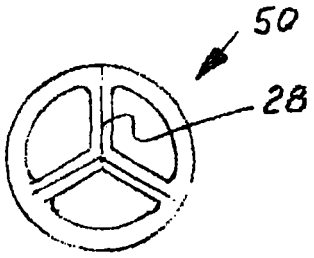
FIG. 6 is a top view of the present general inventive concept for piercing the capsule.
Figure 8:
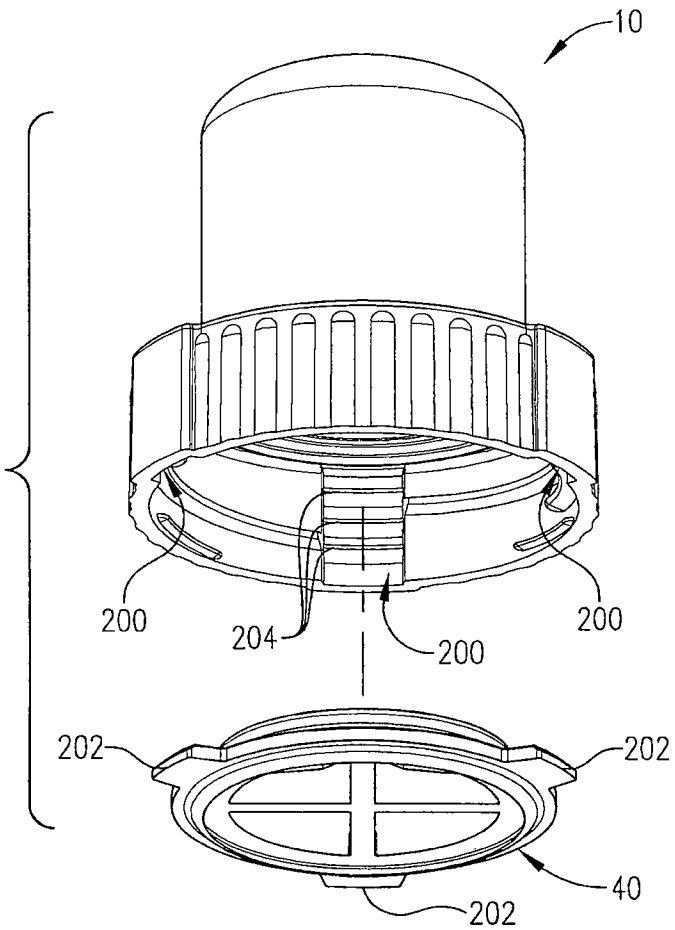
FIG. 8 is a perspective view of the present general inventive concept illustrating a multi-thread cap design.
Figure 7:
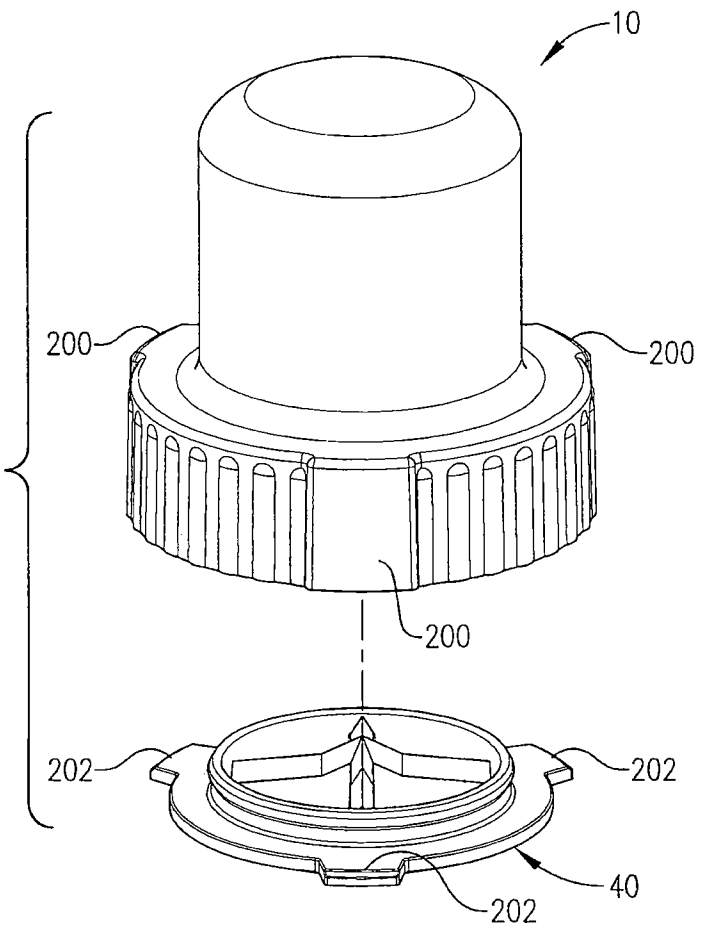
FIG. 7 is a perspective view of the present general inventive concept illustrating a multi-thread cap design.

Reference is now made, more particularly, to FIGS. 1-3 of the drawings. Illustrated therein is a presently preferred embodiment of a universal bottle cap, generally designated 10. The universal bottle cap 10 is preferably formed from plastic and has a predetermined substance retained therein. Such universal bottle cap 10 is selectively engageable with a plurality of different sized and/or shaped bottles such as bottle 12 (see FIG. 5) containing a preselected beverage therein and having a threaded end 14 (see FIG. 5) for receiving the universal bottle cap 10.

The universal bottle cap 10 is a cylindrical member 16 closed at a first end 18 thereof and opened at a second end 20 thereof. The cylindrical member 16 has each of a first predetermined length and a predetermined inside diameter.

A threaded portion 22 is disposed on an inner surface 24 of the cylindrical member 16, beginning adjacent such open end 20 and extending inwardly for a second predetermined length toward the closed end 18, for engaging such threaded end 14 of the bottle 12.

The threaded portion 22 is designed such that the universal bottle cap 10 can mate with two or more bottles each having a different thread design. For instance, a first bottle may have a single lead thread design, a second bottle may have a double lead thread design, and a third bottle may have a triple lead thread design, each mateable with the universal bottle cap 10.

In one embodiment, the threaded portion 22 consists of a first portion and a second portion.

The first portion of the universal bottle cap 10 has a thread pitch of 0.135", a thread start point 0.060" upwards from a bottom edge of the universal bottle cap 10, and a thread duration of 1.1 revolutions.

The second portion of the threaded portion 22 of the universal bottle cap 10 has a thread pitch of 0.125", a thread start point 0.185" upwards from a bottom edge of the universal bottle cap 10, and a thread duration of 1.3 revolutions.

In combination, each of the first and second portions of the threaded portion 22 have a width of 0.050", a thread height of 0.045", a major diameter inside of the universal bottle cap 10 of 1.090", a minor diameter of a thread from peak to peak of 1.000", and a total of 8 separate thread segments.

Further, there is a first means, generally designated 30, disposed inside such cylindrical member 16 adjacent such closed end 18 thereof for retaining the predetermined substance therein which is to be dispensed into such preselected beverage contained within the bottle 12. Such first means 30 is preferably a capsule 26.

A second means, generally designated 40, is engageable with each of such threaded portion 22 of the universal bottle cap 10 and such first means 30 retaining such preselected substance for piercing such first means 30 as the universal bottle cap 10 is threaded onto such threaded portion of such bottle 12 thereby releasing the contents of such first means 30 into such beverage for mixing therewith. In the presently preferred embodiment of the present general inventive concept such second means 40 includes a pyramid shaped upper portion 28.

Such second predetermined length of the threaded portion 22 is at least sufficient to force such second means 40 up far enough to pierce the first means 30.

In the preferred embodiment of the present general inventive concept, the predetermined substance is selected from the group consisting of preselected flavors, liquid vitamins and liquid medications. Such preselected flavors are selected from the group consisting of cherry, strawberry, butterscotch, vanilla, chocolate, raspberry, lemon, lime and orange. The liquid vitamins are multi-vitamins and baby vitamins. The liquid medications include aspirin, cough medicine and antibiotics. Additionally, the preselected beverages include water, juices and soda.

Reference is now made more particularly to FIGS. 3-6. Illustrates therein is an alternative embodiment of a bottle cap, generally designated 10, having a predetermined substance retained therein. As described above, in the first embodiment, the universal bottle cap 10 is engageable with a bottle 12 containing a preselected beverage therein and having a threaded end 14 for receiving the universal bottle cap 10.

In this embodiment of the present general inventive concept, each of the cylindrical member 16, the threaded portion 22 and the a first means 30 disposed inside such cylindrical member 16 are the same as in the embodiment provided supra.

However, in this embodiment, there is a second means, generally designated 50, which engages with each of an upper surface 32 of such bottle 12 and such first means 30 for retaining the preselected substance for piercing the outer surface of first means 30 as such universal bottle cap 10 is threaded onto such threaded portion 14 of such bottle 12 thereby releasing the 20 contents of such first means 30 into such beverage for mixing therewith.

In this embodiment of the present general inventive concept there is a retaining ring 34 that engages with a bottom surface 36 of such second means 30 and an upper surface 32 of such bottle 12 for retaining such second means 50 in position in such universal bottle cap 10 to pierce a capsule 26 containing a predetermined substance selected from the group consisting of preselected flavors, liquid vitamins and liquid medications. The presently preferred preselected flavors, liquid vitamins and liquid medications are the same as the ones discussed above with respect to the first embodiment.

Likewise in this second embodiment, the preselected beverages include water, juices and soda. Also the second predetermined length of such threaded portion 22 is at least sufficient to force such second means 50 up far enough to pierce such first means 30.

The present general inventive concept also provides an opening in an upper side of the cap, such as a spout, such that upon engagement to a bottle and release of contents within the cap, the spout may be selectively opened by pulling the spout away from the bottle and/or selectively closed by pushing the spout toward the bottle, such that when the spout is open, the contents may exit the bottle, e.g., for consumption by a user and the like, without removing the cap yet and when the spout is closed, the contents are securely stored within the bottle, e.g., for mixing, storage, and the like.

The present general inventive concept also provides a vertical track 200 to permit the second means 40 to be moved upward and toward the first means 30 with tabs 202 extending from the second means 40 and into the vertical track 200. The vertical track 200 includes bumps 204 to engage the tabs 202.

While a presently preferred and various alternative embodiments of the present general inventive concept have been described in sufficient detail above to enable a person skilled in the relevant art to make and use the same it should be obvious that various other adaptations and modifications can be envisioned by those persons skilled in such art without departing from either the spirit of the present general inventive concept or the scope of the appended claims.

What is claimed is:

1. A bottle cap capable of threadably engaging a bottle having a thread arrangement to receive said bottle cap, said bottle cap comprising:

a cylindrical member closed at a first end thereof and open at a second end thereof, said cylindrical member having each of a first predetermined length and a predetermined inside diameter;

a threaded portion disposed on an inner surface of said cylindrical member, beginning adjacent said open end and extending inwardly a second predetermined length toward said closed end, to engage the thread arrangement of the bottle;

a reservoir disposed inside said cylindrical member adjacent said closed end thereof to retain a substance therein to be dispensed into said bottle; and a reservoir opening element (i) engageable with said bottle cap, (ii) operable to abut an uppermost portion of the bottle, and (iii) operable to pierce said reservoir as said bottle cap is threaded onto the thread arrangement of the bottle thereby releasing the substance of said reservoir into the bottle;

a retaining ring disposed within said cylindrical member to engage a portion of said reservoir opening element so that said reservoir opening element is secured within said cylindrical member, wherein, the uppermost portion of the bottle maintains said reservoir opening element in a fixed position relative to the bottle when said bottle cap is threaded onto the thread arrangement of the bottle.

2. The bottle cap according to claim 1, wherein said second predetermined length of said threaded portion is at least of a length sufficient to permit said reservoir opening element to move upwards to pierce said reservoir.

3. The bottle cap according to claim 1, wherein said reservoir is a capsule.

4. The bottle cap according to claim 1, wherein said reservoir opening element includes a pyramid shaped upper portion.

5. The bottle cap according to claim 1,
wherein,
an entirety of the reservoir opening element is housed within the cylindrical member.

6. The bottle cap according to claim 1,
wherein,
the reservoir opening element includes a plurality of edges (i) extending toward the reservoir, and (ii) operable to extend into the reservoir when the bottle cap is threaded onto the thread arrangement of the bottle.

7. The bottle cap according to claim 1,
wherein,
the fixed position is an abutted position.

8. The bottle cap according to claim 1,
wherein,
the reservoir opening element includes a plurality of tabs (i) extending toward the cylindrical member, and (ii) operable to slidably engage the cylindrical member.

9. A bottle cap capable of threadably engaging a bottle having a thread arrangement, said bottle cap comprising:
a cylindrical member closed at a first end thereof and open at a second end thereof, said cylindrical member having each of a first length and an inside diameter;
a threaded portion disposed on an inner surface of said cylindrical member, beginning adjacent said open end and extending inwardly a second length toward said closed end;
a reservoir disposed inside said cylindrical member adjacent said closed end thereof for retaining a substance therein;
a reservoir opening element (i) operable to slide along a portion of the inner surface of said cylindrical member, (ii) operable to abut an uppermost portion of a bottle, and (iii) operable to pierce said reservoir thereby releasing the substance of said reservoir when said bottle cap is threaded onto the thread arrangement of the bottle; and
a retaining ring disposed within said cylindrical member to engage a portion of said reservoir opening element so that said reservoir opening element is secured within said cylindrical member,
wherein,
the uppermost portion of the bottle maintains said reservoir opening element in a fixed position relative to the bottle when said bottle cap is threaded onto the thread arrangement of the bottle.

10. The bottle cap according to claim 9, wherein said second length of said threaded portion is at least of a length sufficient to permit said reservoir opening element to move upwards to pierce said reservoir.

11. The bottle cap according to claim 9, wherein said reservoir is a capsule.

12. The bottle cap according to claim 9, wherein said reservoir opening element includes a plurality of edges (i) extending toward said reservoir, and (ii) operable to extend into said reservoir when said bottle cap is threaded onto the thread arrangement of the bottle.

13. The bottle cap according to claim 9,
wherein,
the fixed position is an abutted position.

14. The bottle cap according to claim 9,
wherein,
the reservoir opening element includes a plurality of tabs (i) extending toward the cylindrical member, and (ii) operable to slidably engage the cylindrical member.

15. A cap element capable of threadably engaging a thread arrangement of a bottle, the cap element comprising:
an upper wall and a peripheral skirt depending from the upper wall;
a reservoir situated between the upper wall and an end of the skirt;
a reservoir opening element (i) situated entirely between the upper wall and the end of the skirt, (ii) operable to abut an uppermost portion of a bottle, and (iii) operable to pierce the reservoir when the cap is threaded onto the bottle; and
a retaining ring (i) situated between the upper wall and the end of the skirt, and (ii) operable to engage a portion of the reservoir opening element so that the reservoir opening element is secured within the cap element,
wherein,
the reservoir opening element is operable to abut the uppermost portion of the bottle when the cap element is threaded onto the thread arrangement of the bottle, and
the reservoir opening element is operable to maintain an abutted position with the uppermost portion of the bottle when the cap element is threaded further onto the thread arrangement of the bottle.

16. The cap element according to claim 15, the cap element further comprising:
one of a helical track or a vertical track to permit the reservoir opening element to be moved upward and toward the lower wall.

17. The cap element according to claim 15, the cap element further comprising:
a substance housed within the reservoir that is releasable by the reservoir opening element.

18. The cap element according to claim 15, wherein the reservoir opening element has at least one aperture therethrough.

19. The cap element according to claim 15,
wherein,
the reservoir opening element includes a plurality of sloped edges operable to (i) engage the reservoir, and (ii) at least partially extend into the reservoir.

20. The bottle cap according to claim 19,
wherein,
the reservoir opening element includes at least three apertures spaced about a center portion of the reservoir opening element, and
the at least three apertures are operable to allow the substance to pass through the reservoir opening element after (i) the bottle cap is threaded onto the thread arrangement of the bottle, and (ii) the reservoir opening element pierces the reservoir.

21. The cap element according to claim 15,
wherein,
the reservoir opening element includes a plurality of tabs (i) extending toward the skirt, and (ii) operable to slidably engage the skirt.

22. The cap element according to claim 21, wherein, the skirt includes at least one tab abutment surface operable to abut at least one of the plurality of tabs.

* * * * *